US008418947B2

(12) United States Patent
Chan

(10) Patent No.: US 8,418,947 B2
(45) Date of Patent: Apr. 16, 2013

(54) SHREDDING MECHANISM FOR PAPER

(76) Inventor: Stephen Kwok Ki Chan, Kowloon Tong (CN)

( * ) Notice: Subject to any disclaimer, the term of this patent is extended or adjusted under 35 U.S.C. 154(b) by 0 days.

(21) Appl. No.: 13/033,760

(22) Filed: Feb. 24, 2011

(65) Prior Publication Data

US 2012/0217331 A1 Aug. 30, 2012

(51) Int. Cl.
*B02C 18/16* (2006.01)

(52) U.S. Cl.
USPC ..... 241/295; 241/236

(58) Field of Classification Search ..... 241/236, 241/295
See application file for complete search history.

(56) References Cited

U.S. PATENT DOCUMENTS

| | | | | |
|---|---|---|---|---|
| 1,750,941 | A * | 3/1930 | Pardee | 241/235 |
| 1,851,683 | A * | 3/1932 | Pertwee | 241/294 |
| 2,472,188 | A * | 6/1949 | Clark et al. | 241/243 |
| 3,027,106 | A * | 3/1962 | Brooks | 241/294 |
| 5,897,066 | A * | 4/1999 | Bacon et al. | 241/160 |
| 7,533,839 | B2 * | 5/2009 | Wang | 241/295 |
| 7,637,448 | B2 * | 12/2009 | Hartnett et al. | 241/236 |
| 7,641,136 | B2 * | 1/2010 | Chen | 241/166 |
| 7,931,224 | B2 * | 4/2011 | Chen | 241/236 |
| 2005/0109866 | A1 * | 5/2005 | Hunag | 241/295 |
| 2006/0102763 | A1 * | 5/2006 | Bai | 241/295 |

* cited by examiner

*Primary Examiner* — Faye Francis
(74) *Attorney, Agent, or Firm* — Leydig, Voit & Mayer, Ltd.

(57) ABSTRACT

A paper shredding mechanism has two rows of shredding units rotating in opposite directions. Each unit has a flat body, with a periphery and left and right sides, and at least one piercer projecting from the periphery for piercing and cutting a paper sheet fed between the two rows. The piercer cuts in a first direction, transverse to the paper feeding direction, and has a shearing edge on each of the left and right sides, alongside the periphery. The piercer has a cutting edge which extends across the left and right sides of the body. The shearing edge of each of the units bears laterally against the shearing edge of an adjacent unit. The two shearing edges together act as shears, cutting the paper sheet in a second direction, parallel to the feeding direction.

17 Claims, 10 Drawing Sheets

SHREDDING MECHANISM FOR PAPER

The present invention relates to a shredding mechanism for shredding paper or other sheet-like material, and to a shredder incorporating the same.

BACKGROUND OF THE INVENTION

Paper shredders are amongst those equipment that are indispensable to an office. Paper shredders tend to be bulky and power hungry, often requiring use of the mains power for sufficient power to operate. With reduction in the size, an increasing number of relatively more compact paper shredders find their way into the domestic market, but in the majority of cases they are still bound to mains power operation.

Battery operation is desirable for use at home because of the freedom to move around and be useable at different locations. However, not until the problem of power requirement is solved or at least lessened, size cannot be further reduced and battery operation is not practical. In any event, saving in power consumption is at all time welcome for environmental protection.

The invention seeks to mitigate or at least alleviate such problem by providing a new or otherwise improved shredding mechanism for paper or the like sheet material.

SUMMARY OF THE INVENTION

According to the invention, there is provided a shredding mechanism for shredding paper or the like sheet material, comprising two rows of shredding units mounted for rotation in opposite directions about respective parallel axes, the shredding units of one of the two rows being overlapped with those of the other row in an interlaced manner. At least one of shredding units comprises a generally flat body having a periphery and left and right sides on opposite sides of the periphery, at least one piercer projecting from the periphery of the body for piercing and cutting a sheet of paper or the like fed through between the two rows of shredding units, cutting in a first direction transversely of the direction of feeding, the piercer having a cutting edge which extends at least partially across the left and right sides of the body, and a shearing edge on each of the left and right sides extending alongside the periphery, the shearing edge bearing laterally against a shearing edge of an adjacent shredding unit of the other row, the two shearing edges together acting as shears for cutting a said sheet of paper or the like in a second direction parallel to the direction of feeding.

Preferably, the cutting edge of the piercer extends substantially continuously and completely across the left and right sides of the body.

Preferably, the piercer extends laterally across substantially the entire width of the shredding unit.

It is preferred that the piercer has at least one pointed end for initially piercing through a said sheet of paper or the like.

It is further preferred that the pointed end of the piercer is part of the cutting edge.

It is further preferred that the cutting edge of the piercer has two sections which are inclined relative to each other and meet at the pointed end.

It is further preferred that the piercer has one single said pointed end that is V-shaped.

In a specific construction, the cutting edge of the piercer has a flat front side in the direction of rotation of the shredding unit and a rear side which is chamfered to meet and form the cutting edge with the front side.

It is advantageous that the cutting edge of the piercer is a smoothly sharpened edge.

It is preferred that the piercer projects at an angle in the range of 80° to 90° relative to the periphery of the body, forwardly in the direction of rotation of the shredding unit.

In a preferred embodiment, the shredding unit includes a plurality of said piercers at equiangular positions around the body.

More preferably, the shredding unit includes three said piercers at an angle of 120° apart around the body.

It is preferred that the or each piercer is made of metal material.

In a preferred embodiment, the body has a slot having an open end at the periphery of the body, and the piercer is a distinct member from the body and is located partially in the slot, the piercer having an inner end located in the slot and an outer end which projects from the periphery and includes the cutting edge.

More preferably, the slot has an inner end opposite the open end, which inner end and the inner end of the piercer have matching cross-sections for inter-engagement to fix the piercer in the slot.

Further more preferably, the inner ends of the slot and the piercer are both bent or hooked.

Preferably, the slot has an open side on at least one of the left and right sides of the body, through which open side the piercer is inserted laterally into the slot.

Preferably, the periphery of the body includes a protrusion through which the open end of the slot extends, the protrusion supporting opposite sides of the piercer behind the cutting edge.

It is advantageous that the shearing edges comprise smooth sharpened edges.

It is preferred that the shearing edges protrude radially beyond and around the periphery of the body.

In a preferred embodiment, the shearing edges of the shredding unit are provided by respective shredding members distinct from the body, the shredding members being located on the left and right sides of the body.

More preferably, each shredding member comprises a circular disc with an outer rim providing the respective shearing edge.

More preferably, the body and the shredding members on the left and right sides of the body are rotationally inter-engaged for simultaneous rotation.

Further more preferably, the body has, on at least one of its left and right sides, a plurality of protrusions in engagement with respective holes through the shredding member on the same side, whereby the body and the shredding member are rotationally inter-engaged for simultaneous rotation.

Yet further more preferably, the protrusions have outer ends which are expanded to secure the shredding member to the body.

Yet further more preferably, the shredding member has a part surrounding each hole in engagement with a respective protrusion, which part is recessed to accommodate an outer part of the protrusion on or within an outer side of the shredding member, such that said outer side is non-protrusive.

In a specific construction, the shredding members retain the piercer in engagement with the body by covering the left and right sides of the body respectively.

Preferably, the shredding members are made of metal material.

Preferably, the body is made of plastic material.

In a preferred embodiment, the shredding mechanism includes a pair of parallel shafts supported for rotation in opposite directions about respective parallel axes, on which the two rows of shredding units are mounted for rotation by the shafts respectively.

It is advantageous that cutting of a said sheet of paper or the like by the piercer in the first direction is completed before cutting of the same by the shearing edges in the second direction is completed.

The invention also provides a shredder for paper or the like sheet material, including the aforesaid shredding mechanism, a housing with a slot in which the shredding mechanism is located behind the slot, an electric motor for rotating the shredding units, and a battery-operated operating circuit for operating the motor.

BRIEF DESCRIPTION OF DRAWINGS

The invention will now be more particularly described, by way of example only, with reference to the accompanying drawings, in which.

DETAILED DESCRIPTION OF PREFERRED EMBODIMENT

Figure 1:
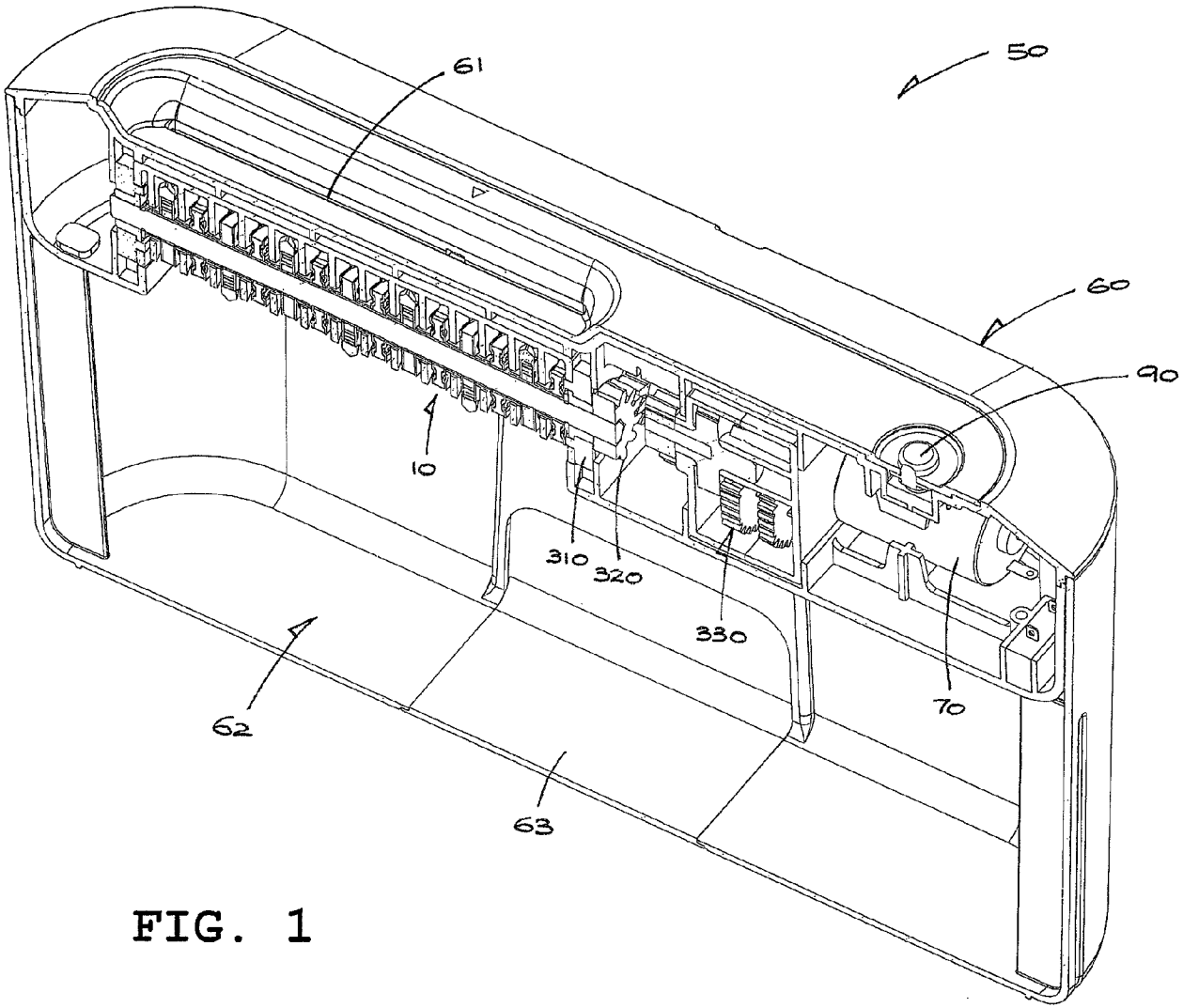
FIG. 1 is a fragmentary perspective view of an embodiment of a shredder in accordance with the invention, cut apart along its length, which incorporates a shredding mechanism for shredding paper or the like inserted into the shredder.
Figure 2:
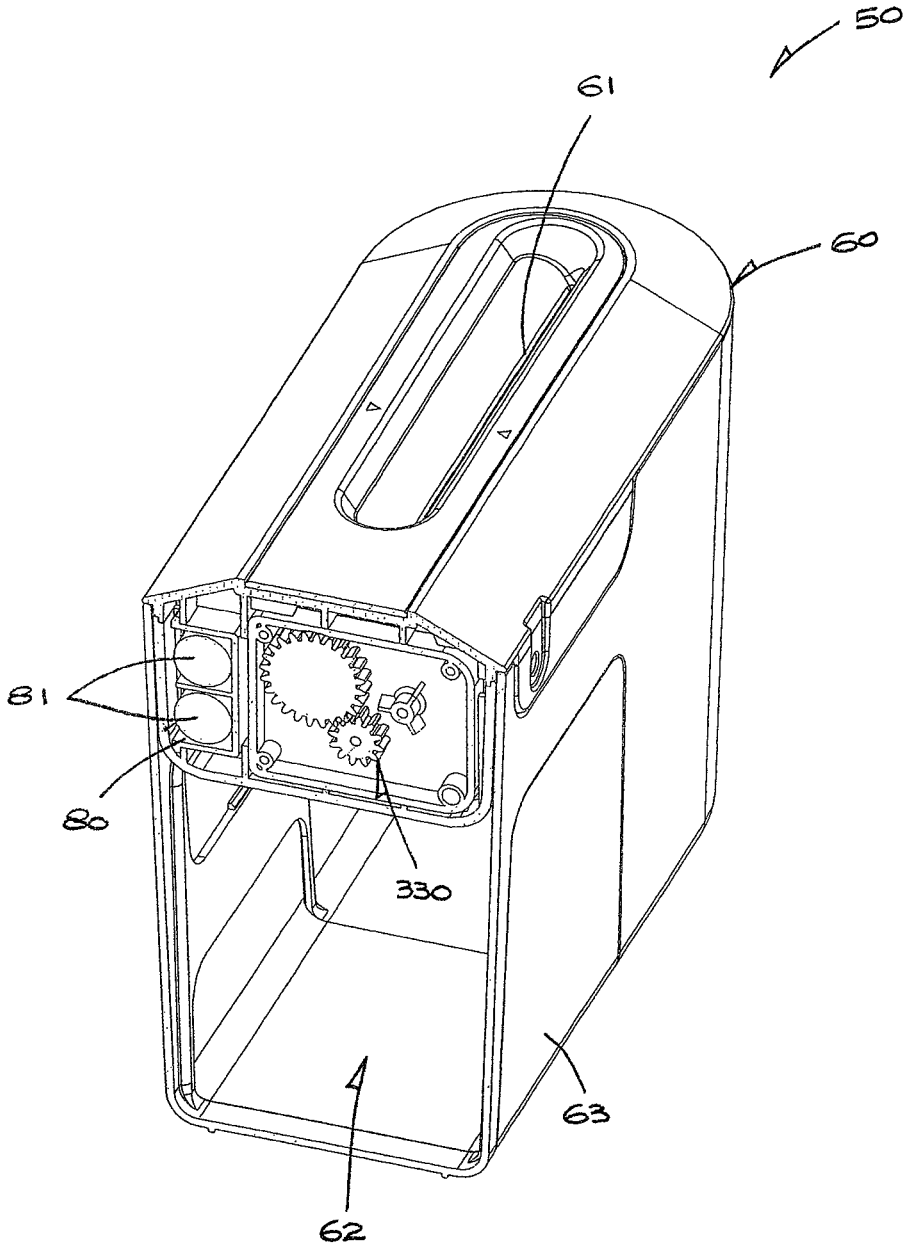
FIG. 2 is a fragmentary perspective view of the shredder of FIG. 1, cut apart across its length.
Figure 3:
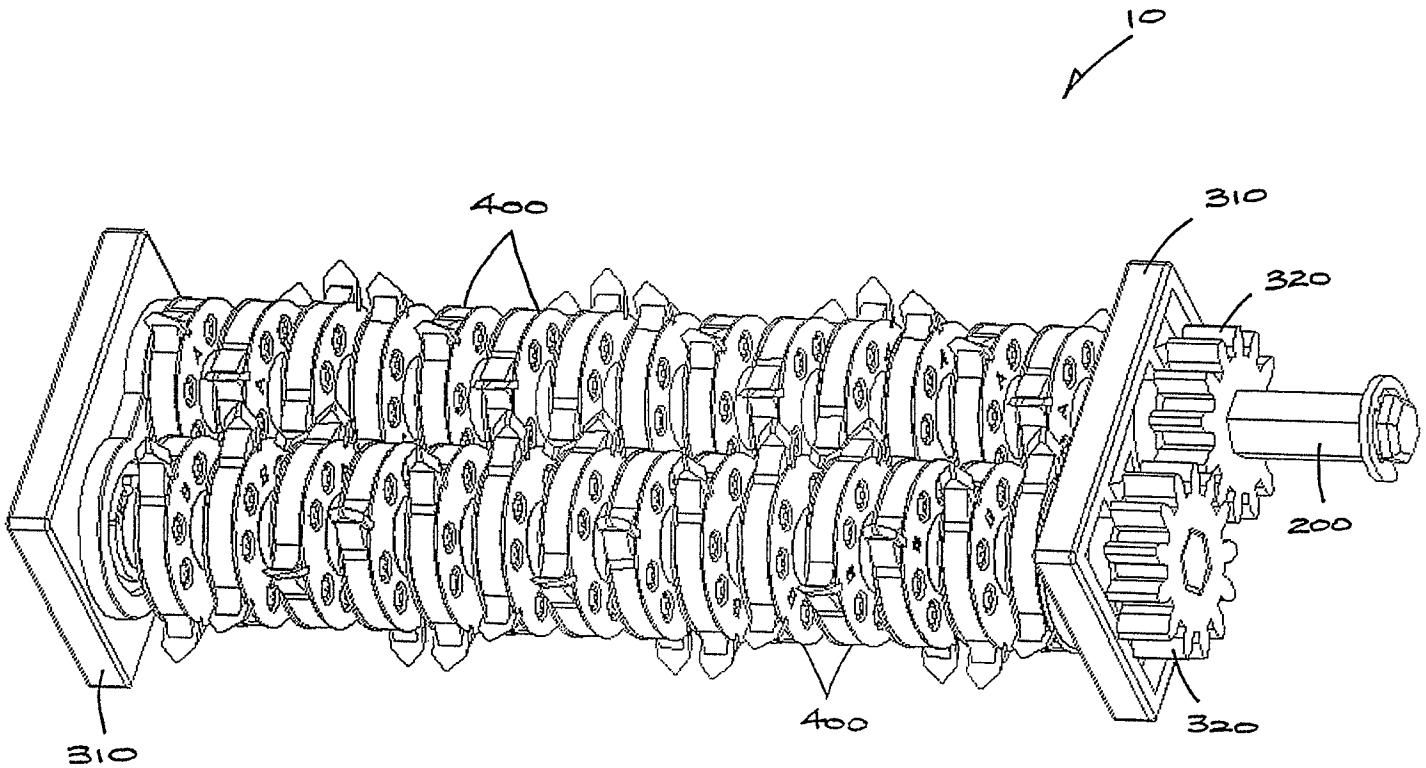
FIG. 3 is a perspective view of the shredding mechanism of FIG. 1, being formed by a pair of rotating shafts and respective rows of shredding units thereon for rotation to shred paper.
Figure 4:
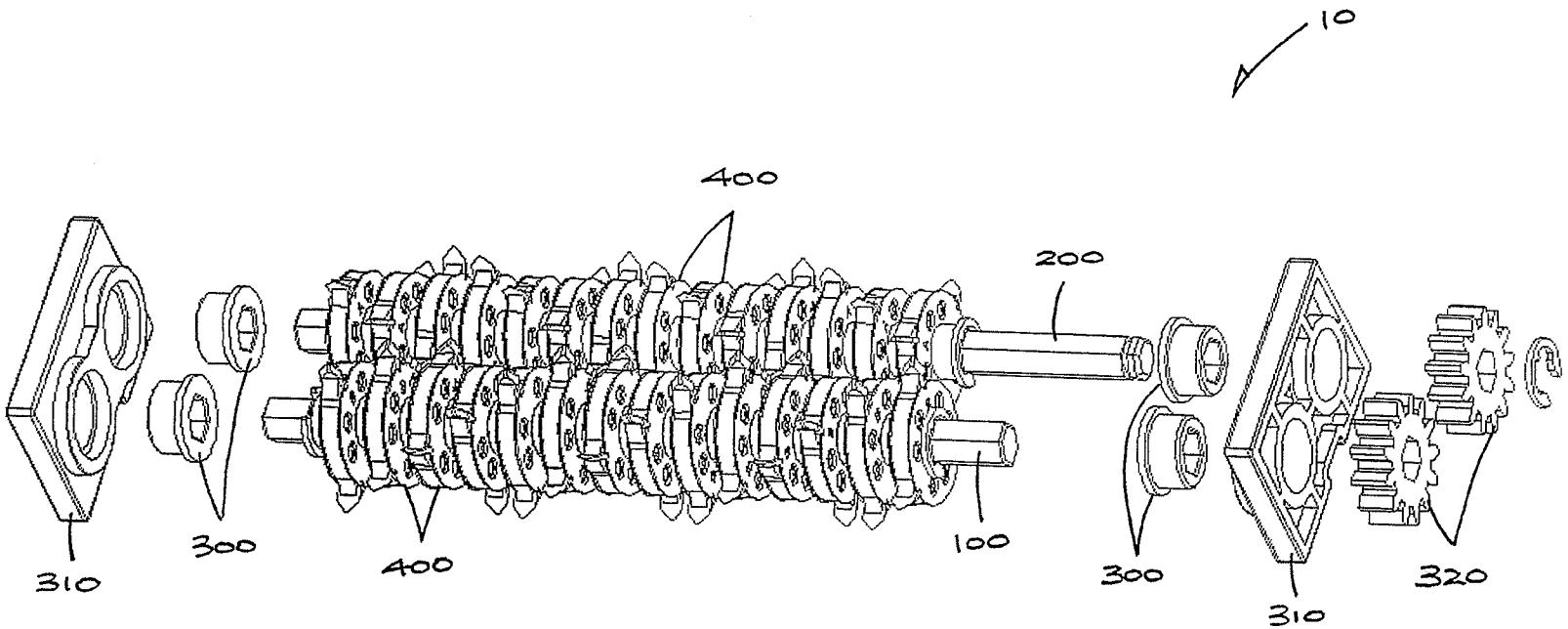
FIG. 4 is a perspective view corresponding to FIG. 1, showing the shredding mechanism with its opposite ends detached from respective end mounts.
Figure 5:
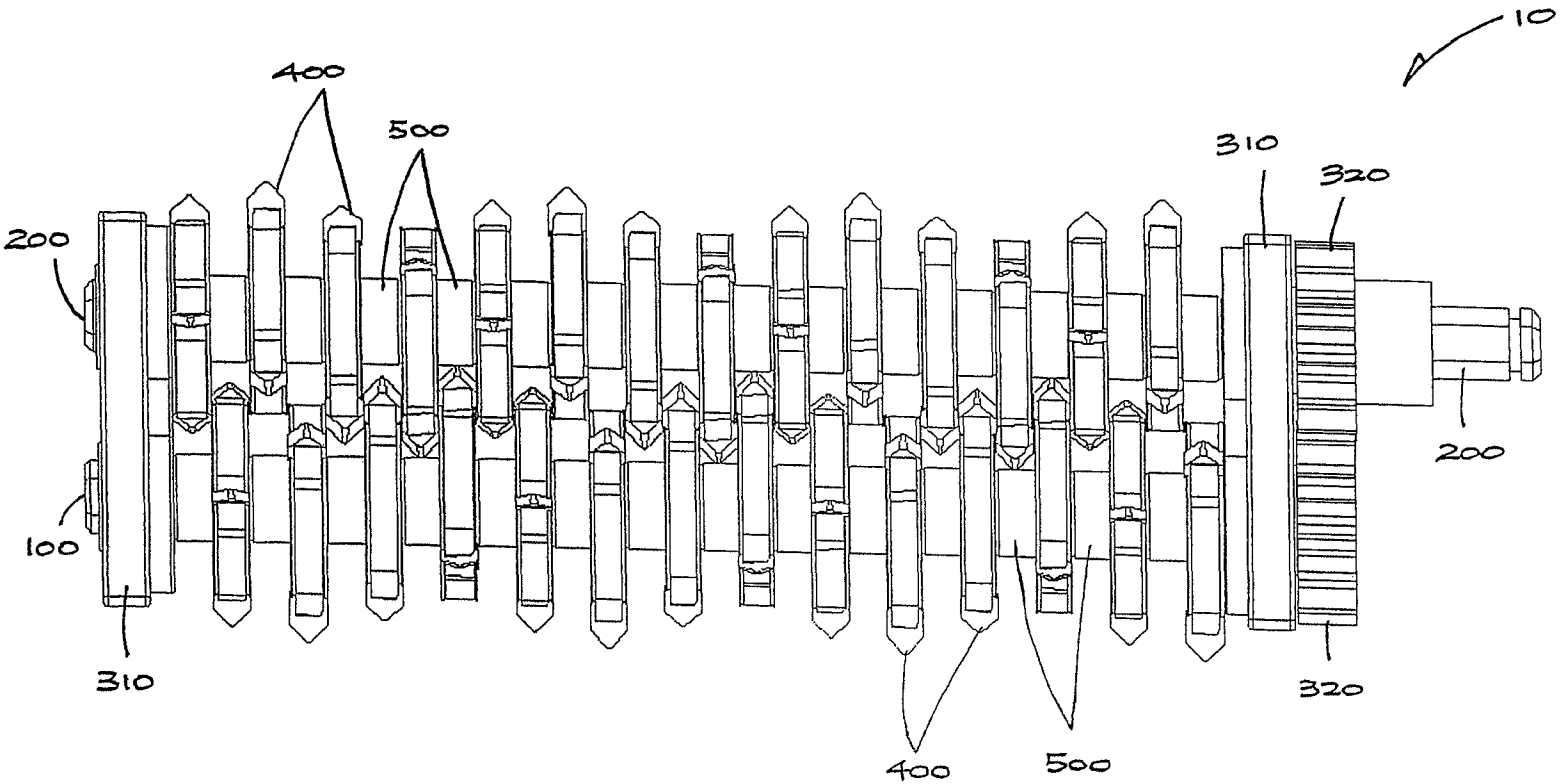
FIG. 5 is a top plan view of the shredding mechanism of FIG. 3.
Figure 6:
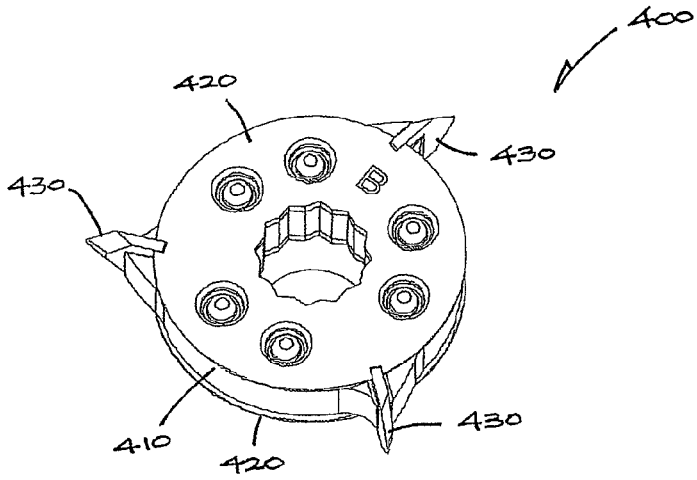
FIG. 6 is a perspective view of one of the shredding units of FIG. 3.
Figure 7:
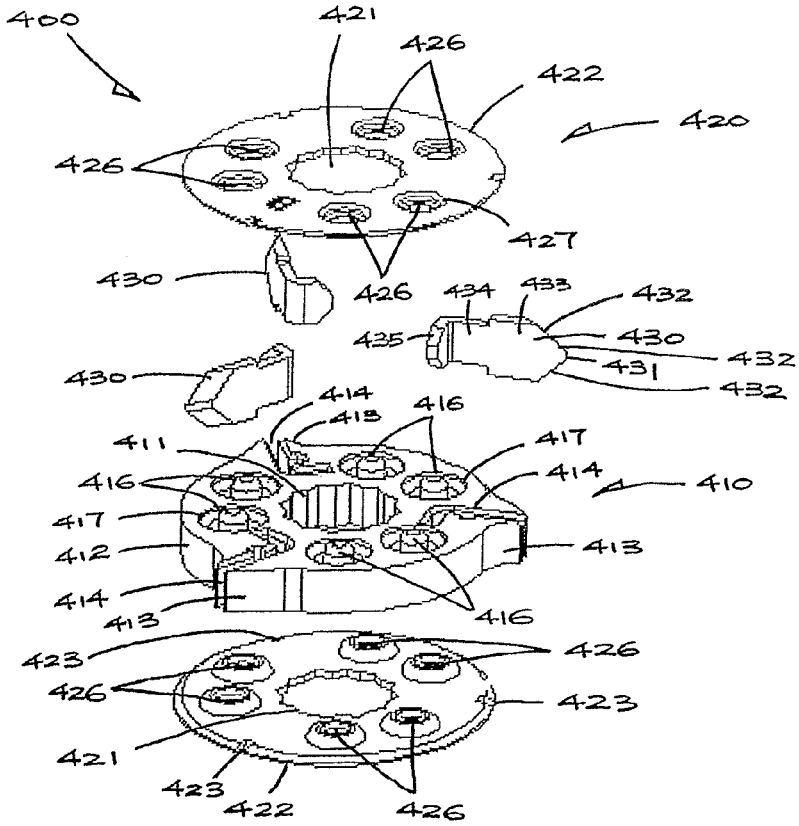
FIG. 7 is an exploded perspective view of the shredding unit of FIG. 6, showing its various parts.
Figure 8A:
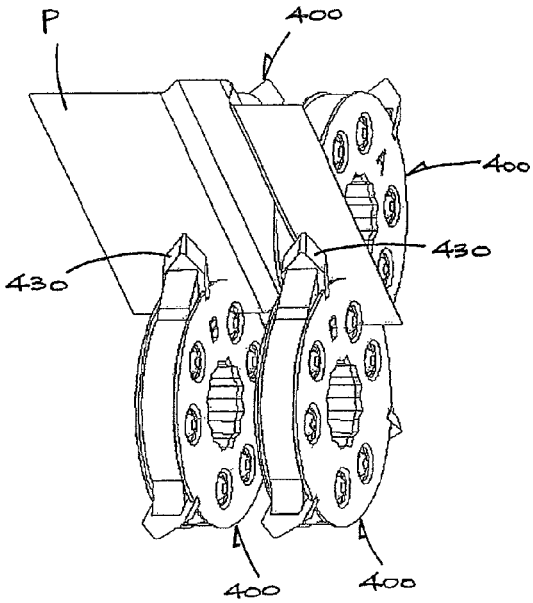
FIGS. 8A to 8D are sequential perspective views of four shredding units of FIG. 3, showing how they cut paper upon rotation through successive angular positions.
Figure 8B:
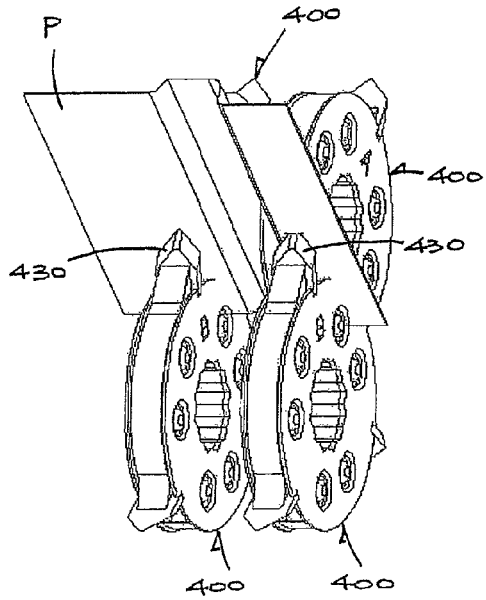
Figure 8C:
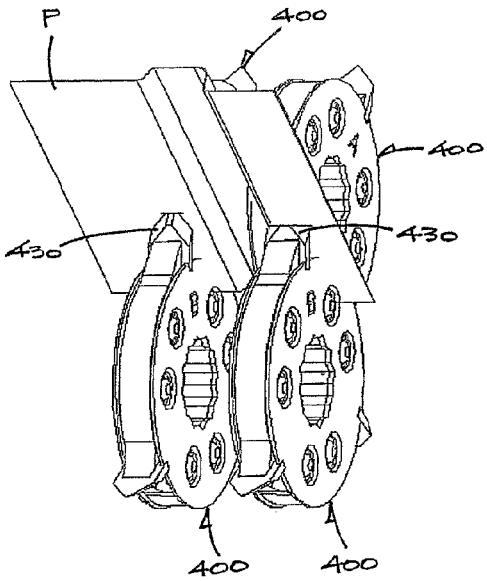
Figure 8D:
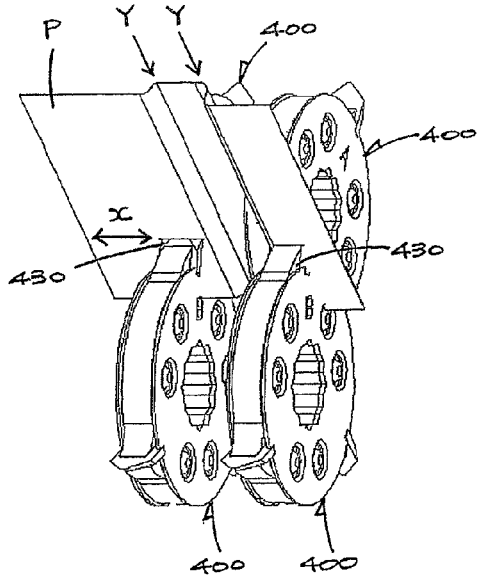
Figure 9:
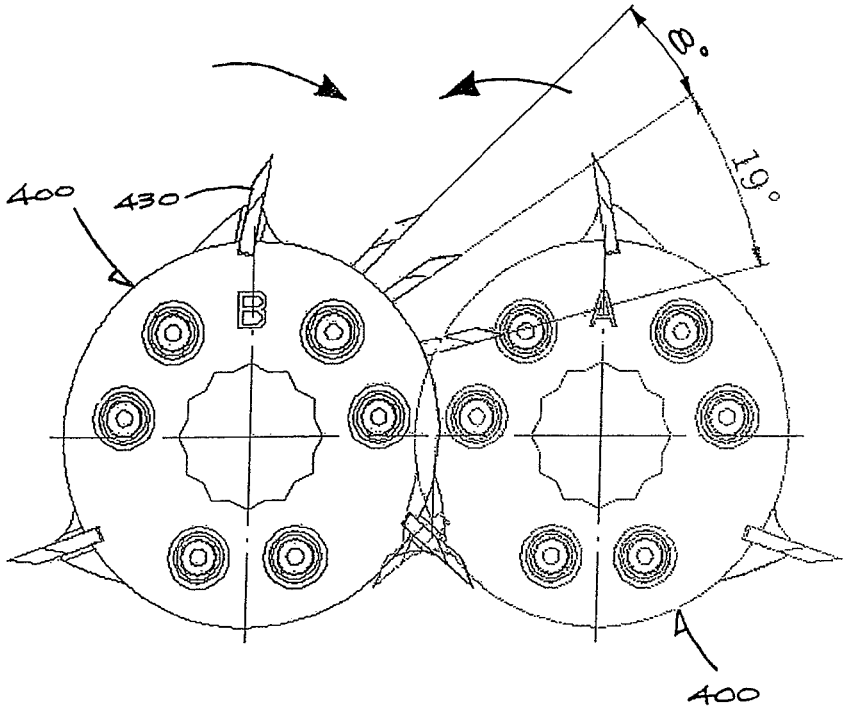
FIG. 9 is a single side view showing the shredding units of FIGS. 8A to 8D at successive angular positions.

Referring to FIGS. 1 to 10D of the drawings, there is shown a shredder 50 incorporating a shredding mechanism 10 for shredding paper or the like sheet material, both embodying the invention, which shredder 50 has a housing 60 with a horizontal slot 61, in which housing 60 the shredding mechanism 10 is located behind the slot 61. Through the slot 61, a sheet of paper P (or the like sheet material) may be inserted into the housing 60 and through the shredding mechanism 10 for shredding by the shredding mechanism 10 into numerous paper strip S of considerably shorter length. The paper shredder 50 includes an electric motor 70 for driving the shredding mechanism 10 via a speed-reduction gear train 330, and a battery-operated operating circuit for operating the motor 70.

The operating circuit includes or is controlled by means of a pushbutton electrical switch 90 on the top of the housing 60. The housing 60 includes a battery compartment 80 for holding a number of DC battery cells 81 of the dry or rechargeable type, and a relatively large cabinet 62 directly underneath the shredding mechanism 10 for collecting the shredded paper strip S. A bottom lid 63 is openable for emptying the cabinet 62.

The paper shredding mechanism 10 is constructed by a pair of hexagonal-sectioned shafts 100 and 200 supported for rotation about respective co-parallel horizontal axes and a row of flat shredding units 400 mounted on each of the shafts 100 and 200 for rotation by the shaft 100/200. The shafts 100 and 200 are mounted at each of their left and right ends by a pair of bearings 300 through a common end mount 310. A pair of inter-meshing gearwheels 320 at their right ends drivingly couples the two shafts 100 and 200 together, and in turn their shredding units 400, for simultaneous rotation in opposite rotations at the same speed, towards each other when viewed from above. One of the gearwheels 320 is in drive engagement with the gear train 330 at its output end for rotation by the motor 70 driving through the gear train 330.

The shredding units 400 on one of the shafts 100/200 are overlapped with those on the other shaft 200/100 in an interlaced manner. The axial space between adjacent shredding units 400 on the same shaft 100/2000 is taken up and maintained by a plain cylindrical spacer of the same thickness as the shredding units 400 but a much smaller diameter.

In operation, the paper shredding mechanism 10 cuts a sheet of paper P or the like, fed through into the gap between the two rows of shredding units 400, into numerous much shorter paper strip S.

The shredding units 400 share substantially the same general construction, but this is not necessarily the case for e.g. the shredding units at either end of the shaft 100/200 or in different embodiments. Each shredding unit 400 has a generally flat, and preferably cylindrical, body 410 having a round periphery 412, left and right sides on opposite sides of the periphery 412, and a central hole 411 across the left and right sides, through which hole 411 the associated shaft 100/200 extends to mount fast the shredding unit 400 thereon for rotating the same. The body 410 is preferably made of plastic material.

Each shredding unit 400 includes a shearing edge 422 on each of its left and right sides extending alongside the periphery 412. The shearing edge 422 bears laterally against the shearing edge 422 of an adjacent shredding unit 400 on the other shaft 200/100, with the two shearing edges 422 together acting as a pair of shears for cutting the paper sheet P into paper strips, in generally vertical direction Y parallel to the direction of feeding. The shearing edges 422 are preferably smooth sharpened edges and in particular protrude radially slightly beyond and completely around the periphery 412.

The shredding unit 400 further includes at least one or three, as in the present case, piercers 430 which project from the periphery 412 of the body 410 for cutting the paper sheet P in generally horizontal direction X transversely of (i.e. at right angles to) the direction of paper feeding. The piercers 430 are distinct members and arranged at equiangular positions around the body 410 i.e. at an angle of 120° apart, each projecting at an angle in the range of 80° to 90° relative to the periphery 412 of the body 410, forwardly in the direction of rotation of the shredding unit 400. The piercers 430 are preferably made of metal material e.g. iron or steel.

Each piercer 430 is stamped out from a 0.5 mm thick metal sheet and then machined to have a flat front end portion 433 and a rear end portion 434, the latter being folded into a right-angled hook 435. The front end portion 433 has at least one pointed front end 431 (or tip), and preferably only one single pointed end as in the present case, for initially piercing through the paper sheet P. The pointed end 431 is V-shaped and preferably symmetrically V-shaped as is the case. It does not have to be sharp to a fine point, and preferably not so for mechanical strength.

The front end portion 433 also has a cutting edge 432 in two sections on opposite sides of the pointed end 431 respectively, which are inclined relative to each other and meet at the pointed end 431. The pointed end 431 is part of the cutting edge 432, together being generally V-shaped. The cutting edge 432 has a flat front side in the direction of rotation of the shredding unit 400, which is also the piercing direction, and a rear side which is chamfered (or beveled) to meet and form the cutting edge 432 with the front side. The cutting edge 432 thus formed in this way have a forward cutting angle for effective piercing. The front end portion 433 is slightly wider than the rear end portion 434, for a reason explained below.

The cutting edge 432 is smoothly sharpened for cutting or slicing the paper sheet P, upon the paper sheet P being pierced through by the pointed end 431 and in opposite directions X to the left and right from the pointed end 431. The cutting edge 432 should extend at least partially across the left and right sides of the body 410, and preferably it extends substantially continuously and completely across the left and right sides of the body 410, to ensure shearing or cutting of the paper sheet P across the entire width of the paper strip S to be shredded into, without the paper being torn or pulled apart during this process.

It is noted that the shredding units 400 may have an integral body construction in which the shearing edges 422 are provided by integral parts of the body 410, but in the present embodiment the shearing edges 422 are provided by respective shredding members in the form of circular shredding discs 420 which are distinct from but stacked upon opposite sides of the body 410 in a multi-layer structure. The discs 420 are thin discs, considerably thinner than the body 410. Whilst the discs 420 would have to be made of metal material (e.g. iron or steel) for sufficient strength to cut, the body 410 is preferably made of plastic material, preferably with a hollow structure, as in the present case for substantial reduction in production cost as well as weight.

A lower production cost is certainly advantageous. As to the reduction in weight, and hence inertia, it diminishes the magnitude of force required to start rotation of the shredding mechanism 10. Such saving in the startup force is an important factor that makes battery operation practical. The weight of each shredding unit 400 is about 3.6 g, which is substantially reduced from 12 g that being the weight of a known equivalent.

The shredding discs 420 are located on the left and right sides of the body 410, each having an outer rim 422 that provides the respective shearing edge 422. They have respective central holes 421 of the same shape and size as the hole 411 of the body 410. The three holes 411 and 421 are aligned and share a common non-circular shape, i.e. a twelve-pointed star shape, in rotational engagement with a non-circular hexagonal cross-section of the associated shaft 100/200. In particular, the body 410 and the two discs 420 on opposite sides thereof are rotationally inter-engaged for simultaneous rotation.

More specifically, the body 410 has, on each of its left and right sides, six protrusions 416 in engagement with respective holes 426 through the shredding disc 420 on the same side, whereby the body 410 and both discs 420 are rotationally inter-engaged for simultaneous rotation. Each protrusion 416 is formed in a respective recess 417 in the body 410 such that the protrusion 416 is kept within the relevant side of the body 410.

The shredding disc 420 has a part 427 surrounding each of its holes 426 in engagement with a respective protrusion 416, which part 427 is recessed to accommodate an outer or free end of the protrusion 416 on or within an outer surface of the disc 420. This results in both sides of the shredding unit 400 being non-protrusive for bearing, on either side, laterally flat against an adjacent shredding unit 400 supported on the other shaft 200/100. The free end of each protrusion 416 is expanded, through thermal or ultrasonic melting, to secure both discs 420 to the body 410, thereby forming a one-piece structure.

The piercers 430 are connected to the body 410 before the shredding discs 420 are attached. The piercers' front end portion 433, including the V-shaped pointed end 431 and cutting edges 432, is slightly wider than their rear end portion 434 including the hook 435, by the thickness of the shredding disc 420 on each side.

For locating the piercers 430, the body 410 is formed with three slots 414 each extending from an outer open end at the body's periphery 412 in an inward direction within 10° from the radial direction, and is then bent or hooked through 90° to terminate at an inner closed end about half way to the central hole 411. Each piercer 430 is tucked into the corresponding slot 414, with its rear/inner end portion 434 received in the slot 414 and its front/outer end portion 433 projecting from the periphery 412. The inner end/end portion of the piercer 430 has a matching or complementary cross-section as its associated slot 414 for inter-engagement to fix the piercer 430 in the slot 414.

The periphery 412 includes a protrusion resembling a beak 413 for each slot 414, through which the open end of the slot 414 extends. The slot's open end is effectively extended or lengthened by the corresponding beak 413 on the periphery 412. The beak 413 serves to support opposite sides of the piercer 430 close behind the latter's cutting edge 432.

Each of the slots 414 has an open side on at least one or, in this example, each of the left and right sides of the body 410, through which open side the piercer 430 is laterally inserted into the slot 414 such that it is fixed lengthwise therewith. Subsequently, the shredding discs 420 are attached onto opposite sides of the body 410 and fixed in place, using the protrusions 416 engaging through the holes 426 and expanded as described above. This completes the one-piece structure for the shredding unit 400. By sandwiching upon and hence covering opposite sides of the body 410, the discs 420 also cover the opposite open sides of the slots 414, thereby retaining the piercers 430 in fixed engagement with the body 410.

The multi-layer construction of the shredding units 400 facilitates changes of the paper shredders at factory, such as the width of the paper strips to produce e.g. narrower to increase the level of privacy or wider for saving in the production cost. The modification only requires the use of a different body 410 of an appropriate thickness, whilst the same shredding discs 420 may still be used. The length of the paper strips to cut out may also be made longer or shorter (again for altering the level of privacy) by changing the number of piercers 430 on each shredding units 400, and similarly this only requires the use of a different shredding unit body having the appropriate number of slots 414.

The shredding discs 420 cover opposite sides of the rear end portions 434 of the piercers 430 but not the front end portions 433 which are exposed through respective small notches as shown. The front end portions 433 are wider than the rear end portions 434 by just the thickness of the disc 420 on each side, such that they extend laterally across substantially the entire width of the overall shredding unit 400 (i.e. the body 410 and the discs 420 on opposite sides thereof combined). This construction ensures that the paper sheet P will be cut or sliced across the entire width of the paper strip S when the latter are being formed, without the paper being torn or pulled open which requires a relatively larger force and hence power.

Figure 10B:
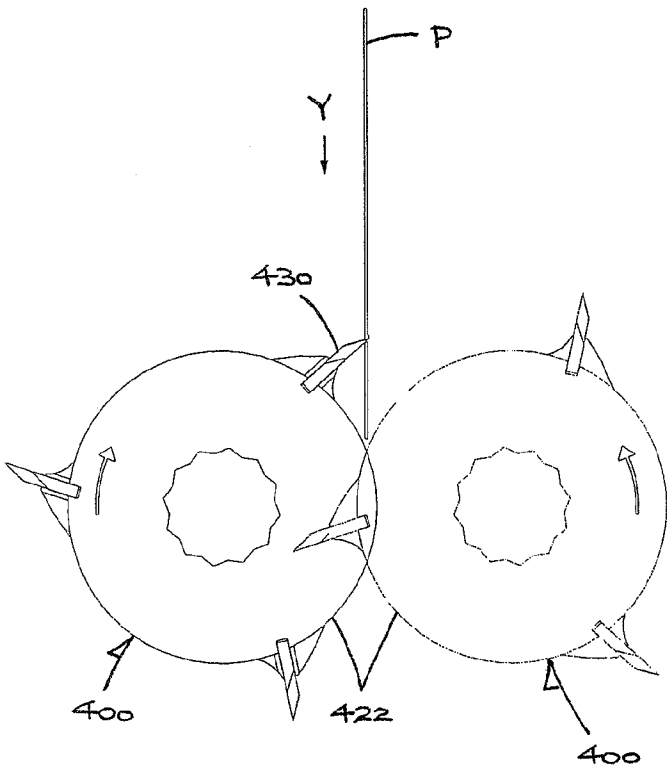
FIGS. 10A to 10D are sequential side views similar to FIG. 9, showing how the shredding units cut paper into short strips.
Figure 10A:
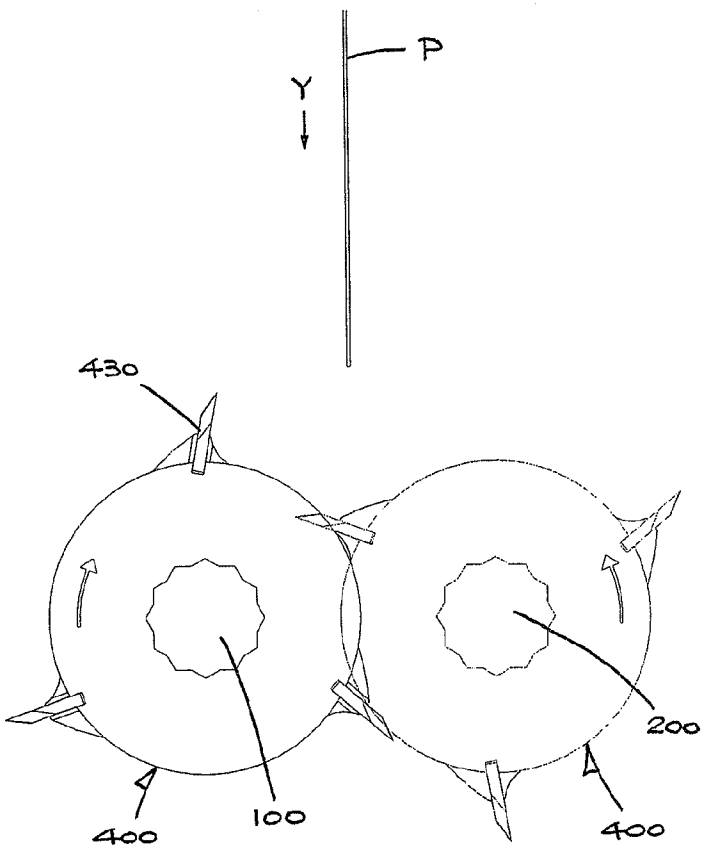
Figure 10D:
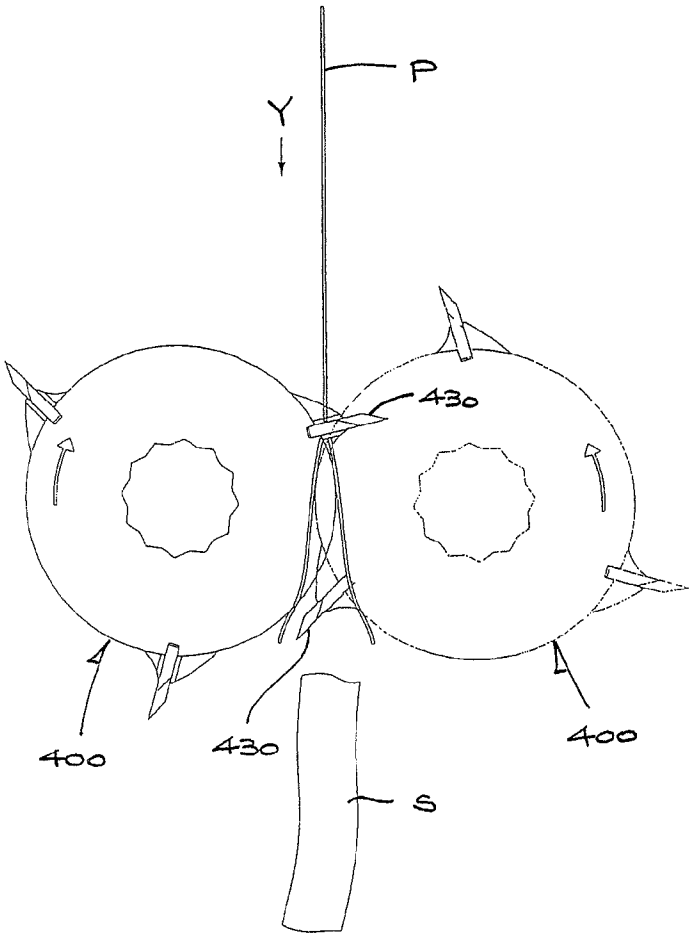
Figure 10C:
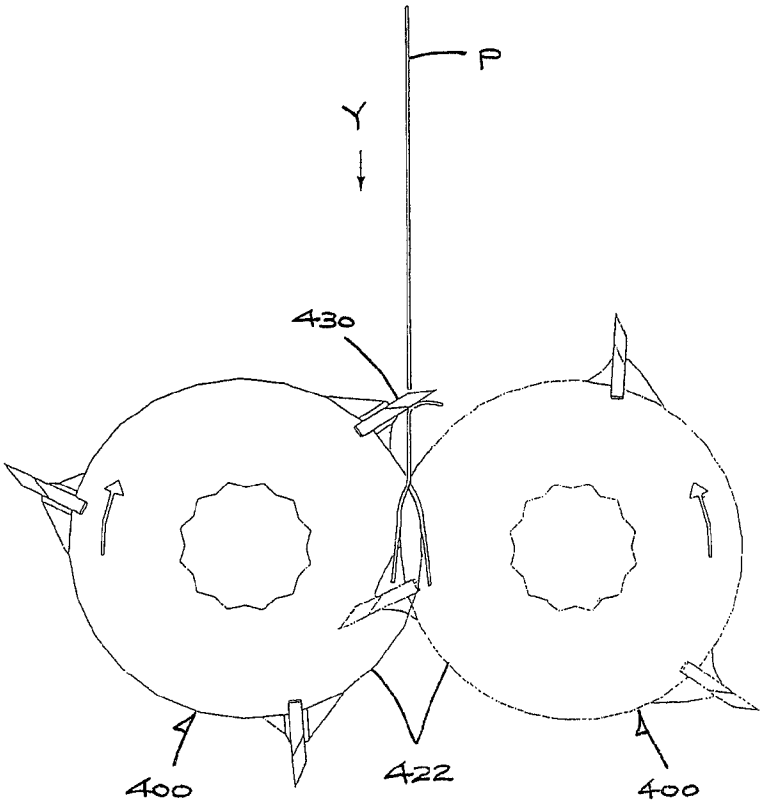

The shredding operation is best illustrated in FIGS. 10A to 10D, which show several (e.g. three) shredding units 400 with the middle unit overlapped with the other two units on respective shafts 100 and 200. Upon being fed into and through the gap between the two rows of shredding units 400 (FIGS. 10A to 10B), the paper sheet P are horizontally cut by the piercer 430 of the middle shredding unit 400 and vertically cut by the shearing edges 433 between the middle shredding unit 400 and the two shredding units 400 on opposite sides thereof. The horizontal (cross) and vertical (straight) cuts may not start at the same time, which depends on inter alia the geometry of the shredding units 400, but they take place concurrently over part of the time (FIG. 10C).

It should be noted that the cross cut is completed or finishes before the straight cut (FIG. 10D). This avoids the situation where the cross cut is still in progress after the straight cut has already finished i.e. opposite sides of the paper strip already formed. This situation is undesirable as the paper strip then becomes completely detached on both sides, loosened or slack and hence inadequately supported for the cross cut to finish clean with minimum strain on the mechanism.

It is particularly advantageous for each piercer 430 to have a continuous sharp cutting edge across the thickness of the shredding unit 400 that is the width of the paper strip to form, such that the cross cut can be a smooth and clean cut which demands the least force. This is one of the factors which make battery operation possible for the paper shredder 50.

It is envisaged that the shredding units may include interlocking formations on opposite sides for engagement between adjacent units to thereby form a self-supporting row without a common central support, in which case the two shafts 100 and 200 may be spared.

Figure 11A:
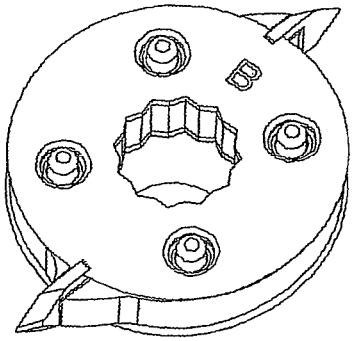
FIGS. 11A and 11B are perspective views of variations of the shredding units of FIG. 3.
Figure 11B:
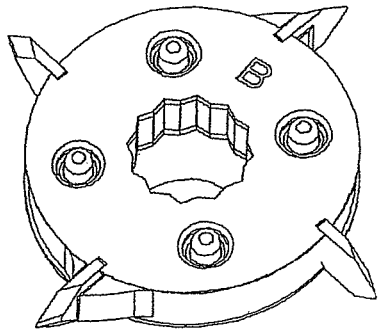

It is also envisaged that the shredding units may incorporate any other suitable number of the aforesaid piercer, such as two as shown in FIG. 11A for cutting out longer strips for cheaper manufactory, or four as in FIG. 11B for shorter strips for higher privacy.

The invention has been given by way of example only, and various other modifications of and/or alterations to the described embodiment may be made by persons skilled in the art without departing from the scope of the invention as specified in the appended claims.

The invention claimed is:

1. A shredding mechanism for shredding sheet material, the shredding mechanism comprising:

first and second parallel shafts supported for rotation in opposite directions about respective parallel first and second axes;

first and second rows of shredding units, wherein the first row of shredding units is mounted on the first shaft and the second row of shredding units is mounted on the second shaft for rotation with the first and second shafts, respectively, alternating shredding units of the first row of shredding units are interleaved between alternating shredding units of the second row of shredding units, the shredding units of the first and second rows overlap when viewed along the first and second parallel axes, each of the shredding units comprises a generally flat body having opposed first and second sides separated by the width of the flat body, and a periphery located between the first and second sides, a central opening passing through the flat body and through which one of the first and second shafts passes and engages the shredding unit, and at least one piercer slot in the flat body for engaging a piercer, wherein the at least one piercer slot extends into the flat body, along the width of the flat body, from the first side of the flat body, and the at least one piercer slot has an inner portion for engaging a piercer and an outer portion extending to and opening at the periphery of the flat body, first and second shredding discs fixedly attached, respectively, to the first and second sides of the flat body, wherein each of the first and second shredding discs includes an outer peripheral rim having a circumferential shearing edge extending outwardly beyond the periphery of the flat body for slitting the sheet material along a direction transverse to the first and second axes, and at least one piercer having a rear end disposed in the inner portion of the at least one piercer slot, and a front end projecting outwardly from the at least one piercer slot, beyond the periphery of the flat body and the shearing edges of the shredding discs attached to the flat body, for piercing and cutting the sheet material along a direction generally parallel to the first and second axes, wherein the front end has a width substantially equal to the width of the flat body plus widths of the first and second shredding discs, and at least one of the first and second shredding discs retains the at least one piercer in the at least one piercer slot, and at least one shearing edge of each of the shredding units in each of the first and second rows bears against a shearing edge of an adjacent shredding unit in the other of the first and second rows so that the shearing edges, bearing on each other, together slit the sheet material along the direction transverse to the first and second axes.

2. The shredding mechanism as claimed in claim 1, wherein the front end of the at least one piercer has a pointed end for piercing the sheet material.

3. The shredding mechanism as claimed in claim 2, wherein the front end of the at least one piercer has a cutting edge with two sections which are inclined relative to each other and meet at the pointed end.

4. The shredding mechanism as claimed in claim 2, wherein the front end of the at least one piercer has only a single pointed end, which is V-shaped.

5. The shredding mechanism as claimed in claim 1, wherein the at least one piercer projects at an angle, in a range of 80° to 90°, relative to the periphery of the flat body, in a direction of rotation of the shredding unit.

6. The shredding mechanism as claimed in claim 1, wherein each shredding unit includes a plurality of piercers located at equiangular positions around the periphery of the flat body.

7. The shredding mechanism as claimed in claim 6, wherein each shredding unit includes three piercers, spaced apart at an angle of 120° from each other, around the periphery of the flat body.

8. The shredding mechanism as claimed in claim 1, wherein the at least one piercer is metal.

9. The shredding mechanism as claimed in claim 1, wherein the inner portion of the at least one piercer slot and the rear end of the at least one piercer have matching cross-sections that engage each other and fix the at least one piercer in the at least one piercer slot.

10. The shredding mechanism as claimed in claim 9, wherein the rear end of the at least one piercer is bent and includes a hook.

11. The shredding mechanism as claimed in claim 1, wherein the periphery of the flat body includes a protrusion extending outwardly from the periphery of the flat body at the outer portion of the at least one piercer slot, supporting the at least one piercer proximate the front end of the at least one piercer.

12. The shredding mechanism as claimed in claim 1, wherein the shearing edges comprise sharpened edges.

13. The shredding mechanism as claimed in claim 1, wherein the flat body has, on each of the first and second sides, a plurality of protrusions, each of the first and second shredding discs includes a plurality of holes, and the first and second shredding discs are respectively fixedly attached to the first and second sides of the flat body by engagement of the respective holes in the shredding discs with corresponding protrusions of the flat body.

14. The shredding mechanism as claimed in claim 13, wherein the protrusions increase in cross-sectional area at outer ends and the outer ends bear against the first and second shredding discs and secure the first and second shredding discs to the flat body.

15. The shredding mechanism as claimed in claim 1, wherein the first and second shredding discs are metal.

16. The shredding mechanism as claimed in claim 1, wherein the flat body is plastic.

17. A shredder for shredding sheet material, including the shredding mechanism as claimed in claim 1, a housing in which the shredding mechanism is located, wherein the housing has a slot and the shredding mechanism is located opposite the slot, an electric motor for rotating the first and second shafts, and a battery-operated operating circuit for operating the electric motor.

* * * * *